US007446254B2

(12) United States Patent
Lee

(10) Patent No.: US 7,446,254 B2
(45) Date of Patent: Nov. 4, 2008

(54) PERCUSSION INSTRUMENT USING TOUCH SWITCH

(76) Inventor: Moon Key Lee, Mi-Sung Apt. 6-309, Pul-Kwang 1 Dong, Eun-Pyung-Ku, Seoul 122-751 (KR)

( * ) Notice: Subject to any disclaimer, the term of this patent is extended or adjusted under 35 U.S.C. 154(b) by 32 days.

(21) Appl. No.: 11/569,959

(22) PCT Filed: Feb. 24, 2005

(86) PCT No.: PCT/KR2005/000492

§ 371 (c)(1),
(2), (4) Date: Dec. 1, 2006

(87) PCT Pub. No.: WO2005/081644

PCT Pub. Date: Sep. 9, 2005

(65) Prior Publication Data

US 2007/0107587 A1 May 17, 2007

(51) Int. Cl.
*G10H 3/00* (2006.01)

(52) U.S. Cl. ..... 84/723; 84/600; 84/411 R; 84/422.1

(58) Field of Classification Search ..... 84/411 R, 84/422.1, 600, 723
See application file for complete search history.

(56) References Cited

U.S. PATENT DOCUMENTS 2,655,071 A * 10/1953 Levay ..... 84/422.1
4,590,838 A * 5/1986 Kashio ..... 84/631
5,062,341 A * 11/1991 Reiling et al. ..... 84/702
5,290,964 A * 3/1994 Hiyoshi et al. ..... 84/600
6,031,176 A 2/2000 Tanaka
6,417,436 B1 * 7/2002 Beyoung-Wook ..... 84/600
6,601,436 B1 8/2003 Senda et al.
6,645,067 B1 * 11/2003 Okita et al. ..... 463/7
2002/0025841 A1 * 2/2002 Nobe et al. ..... 463/1

FOREIGN PATENT DOCUMENTS

EP 0795849 9/1997

* cited by examiner

*Primary Examiner*—Lincoln Donovan
*Assistant Examiner*—Kawing Chan
(74) *Attorney, Agent, or Firm*—IPLA P.A.; James E. Bame

(57) ABSTRACT

Percussion instrument using touch switch. Electric current flows by touching conducting pad with conducting stick. The microcontroller in main portion detects the said electronic current and recognizes which pad is hit by which stick to generate the sound of drum of hit pad. The stick portion may further contain vibration sensor and in this case the microcontroller recognizes the hit impact strength of stick on pad by analyzing the output of vibration sensor to control the volume of sound of drum. The information about playing drum recognized by microcontroller can be transmitted to outer system like PC by communication portion in main portion or used to generate the sound of drum by sound generation portion in main portion and if the communication portion is contained in main portion then the sound generation portion may be omitted.

9 Claims, 7 Drawing Sheets

Fig. 11
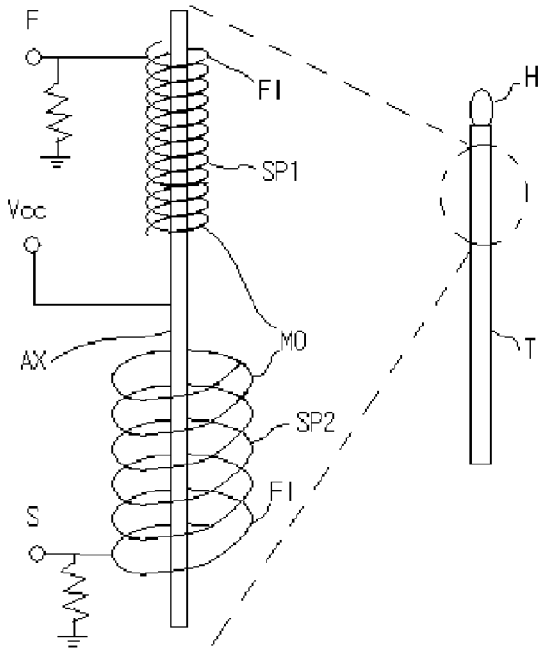
[Fig. 12]
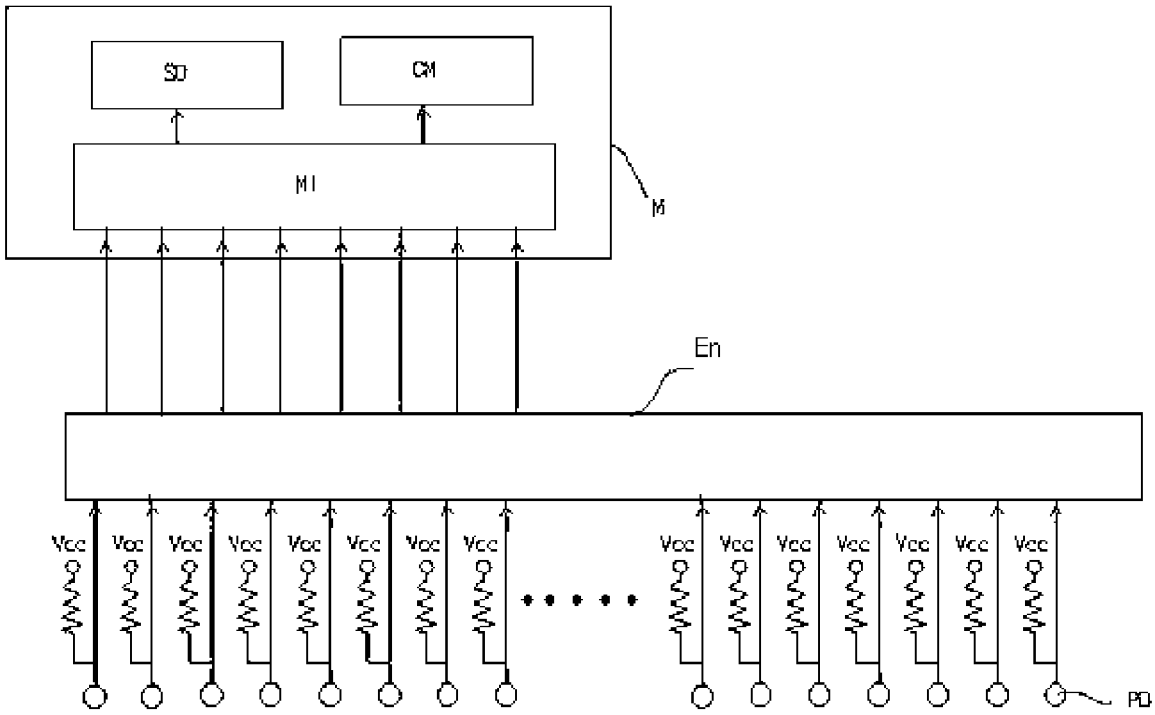

PERCUSSION INSTRUMENT USING TOUCH SWITCH

TECHNICAL FIELD

The present invention relates to electronic drum, and more particularly, by detecting the touching state between conducting pad and conducting stick, and by detecting the impact strength of stick on pad, sound of drum assigned to hit pad is generated at volume proportional to the impact strength of stick on pad.

DISCLOSURE OF INVENTION

Technical Problem

In general, conventional electronic drum generates sound by using pads which contain or connected to vibration sensors to detect which pad is hit and to detect the hit impact strength. Thus, the number of vibration sensor is equal to the number of pad and is costly. Also, the pad requires some mechanical structure to detect vibration. Due to the mechanical structure and housing of pad generally made by expensive die casting, It is difficult to lower the product cost. And the pad must be made of hard material to detect the vibration, The hard material of pad means that the pad can not be folded or rolled to save the occupation space. An operator can not change or reorganize the pad configuration of conventional electronic drum but by using present invention, operator can do that because there is no mechanical structure in pad. It means that any metal sheet or conducting material can be used as pad for present invention. For example, anything which is covered by conducting aluminum tape can be used as pad of the present invention.

Technical Solution

To solve the problem, it is an object of the present invention to provide an electronic drum of pad which has no mechanical structure and to reduce the number of vibration sensor. The pad of present invention can be made of conducting material like sheet or plate which can be rolled or folded. The signal of playing drum of present invention can also be transmitted to a program running in PC or smart phone. In this case, the received signal can be used by game program or drum music program or retransmitted to internet.

BRIEF DESCRIPTION OF THE DRAWINGS

FIG. 11 is a vibration sensor composed of conducting shaft and spring.

FIG. 12 is the circuit of many pads whose number is increased by encoder circuit.

DESCRIPTION OF SYMBOLS IN FIGURE

M: main portion P: conducting pad portion

T: conducting stick portion H: conducting terminal

SD: sound generation portion CM: communication portion

MI: microcontroller PD: conducting pad

LS: left stick RS: right stick

F,S: terminal of conducting spring

SP1,SP2: conducting spring

CY: conducting cylinder FI: fixed part of spring

Figure 10:
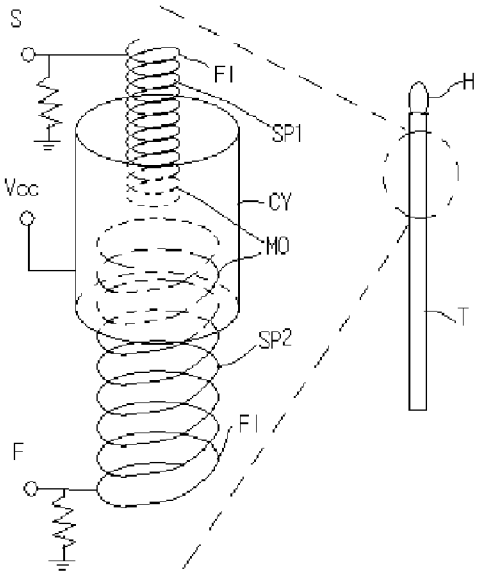
FIG. 10 is a vibration sensor composed of conducting cylinder and spring.

MO: non fixed part of spring AX: conducting shaft t1: time to start touching pad with stick t2: time to stop touching pad with stick tf: time of rise of voltage of terminal F in FIG. 10 and FIG. 11 ts: time of rise of voltage of terminal S in FIG. 10 and FIG. 11

En: encoder De: decoder

BEST MODE FOR CARRYING OUT THE INVENTION

Figure 1:
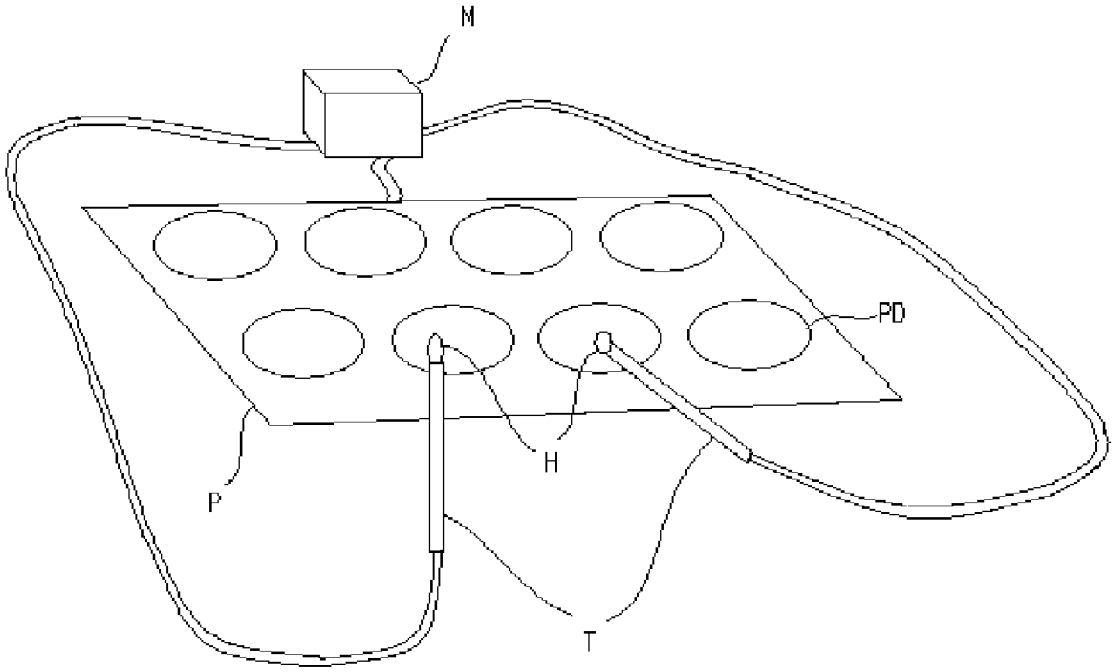
FIG. 1 is the appearance of composition of present invention.

The presented invention is composed of main portion, conducting pad portion, and conducting stick portion as shown in FIG. 1 The main portion contains sound generation portion or communication portion. The sound generation portion generates sound of drum like the sound module in digital piano or sound card in PC and the communication portion transmits the drum playing signal to the outer device like PC or smart phone. The communication portion can be USB interface or MIDI interface. In FIG. 1. an operator plays the drum by hitting the pads with sticks. The number of pads in FIG. 1 is 8. The conducting pad can be any conducting material like metal cup or spoon or conducting rubber. The conducting terminal (H) on the head part of stick in FIG. 1 relays the electric voltage from the hit pad to the microcontroller (MI) in main portion (M) when an operator hits the pad with stick. The microcontroller (MI) interprets the input voltage relayed by stick and recognizes which pad is hit with which stick. The embodiment of the present invention can be classified as following:

The embodiment of the present invention can be classified (1) by the direction of electric current between stick (H) and pad (PD).

(2) by the fact whether it recognizes the sort of hitting stick or not. The recognizing the sort of hitting stick means that the microcontroller (MI) recognizes the hit stick is left stick (LS) or right stick (RS).

The embodiment of the present invention can also be classified (3) by the fact whether it detects the impact strength of hitting stick or not. If the embodiment detects the impact strength of hitting stick then it can be sub classified by the number of spring used in vibration sensor (2 spring or 1 spring)

And the embodiment of the present invention can be classified (4) by the fact whether the number of pad is increased by using encoder or decoder circuit or not.

These are summarized as following table:

TABLE 1

Figure 2:
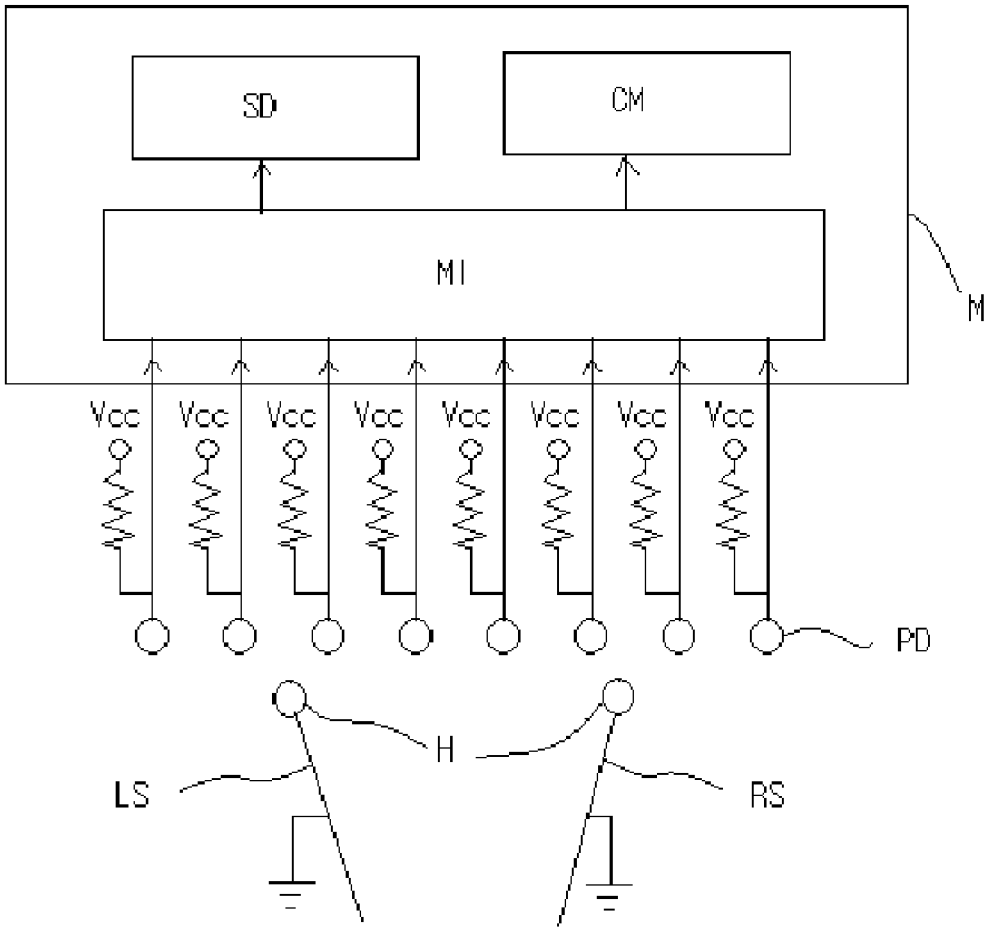
FIG. 2 is the circuit of embodiment 1-1.
Figure 3:
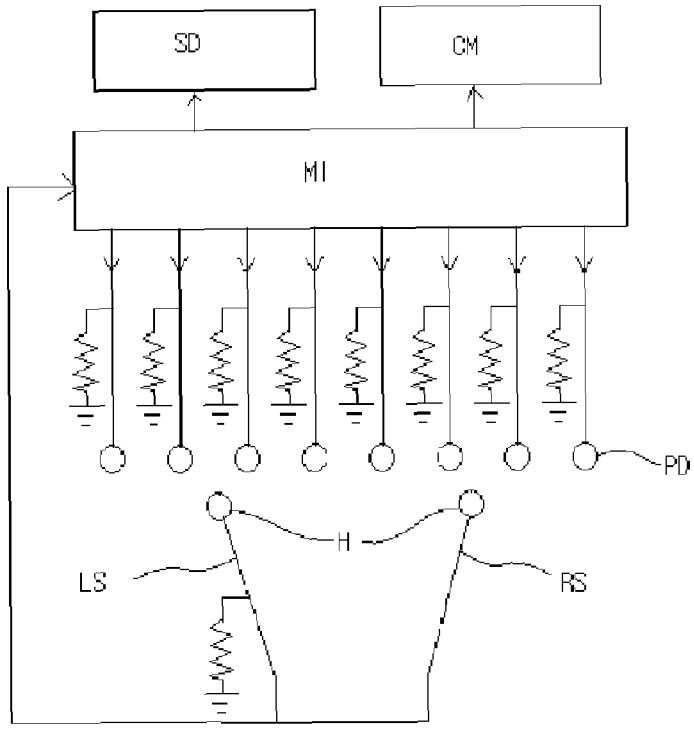
FIG. 3 is the circuit of embodiment 1-2.
Figure 4:
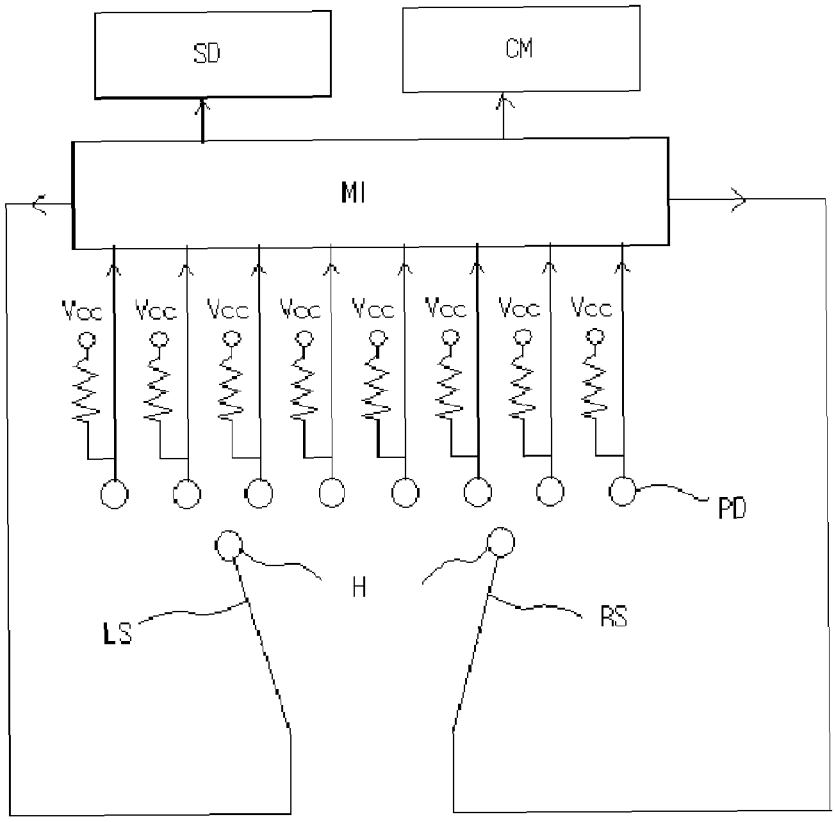
FIG. 4 is the circuit of embodiment 2-1.
Figure 5:
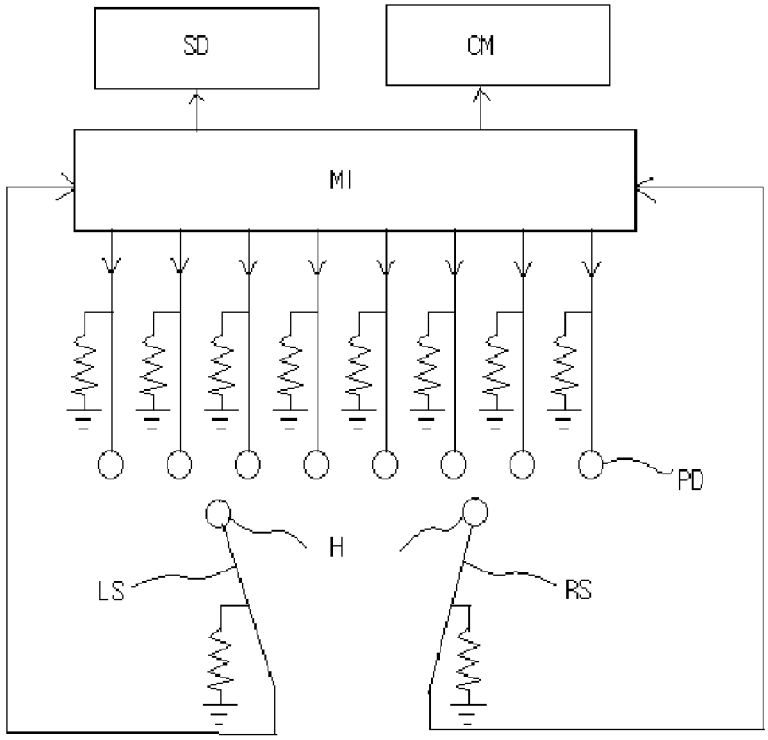
FIG. 5 is the circuit of embodiment 2-2.
Figure 6:
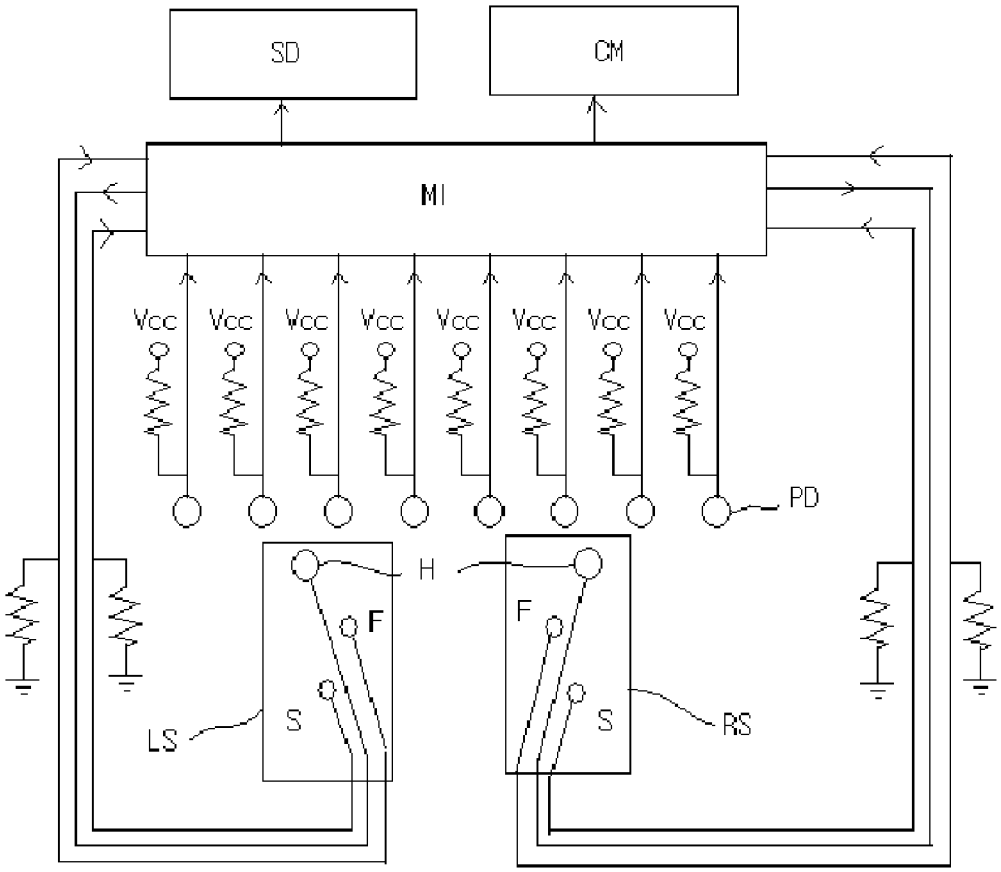
FIG. 6 is the circuit of embodiment 3-1.
Figure 7:
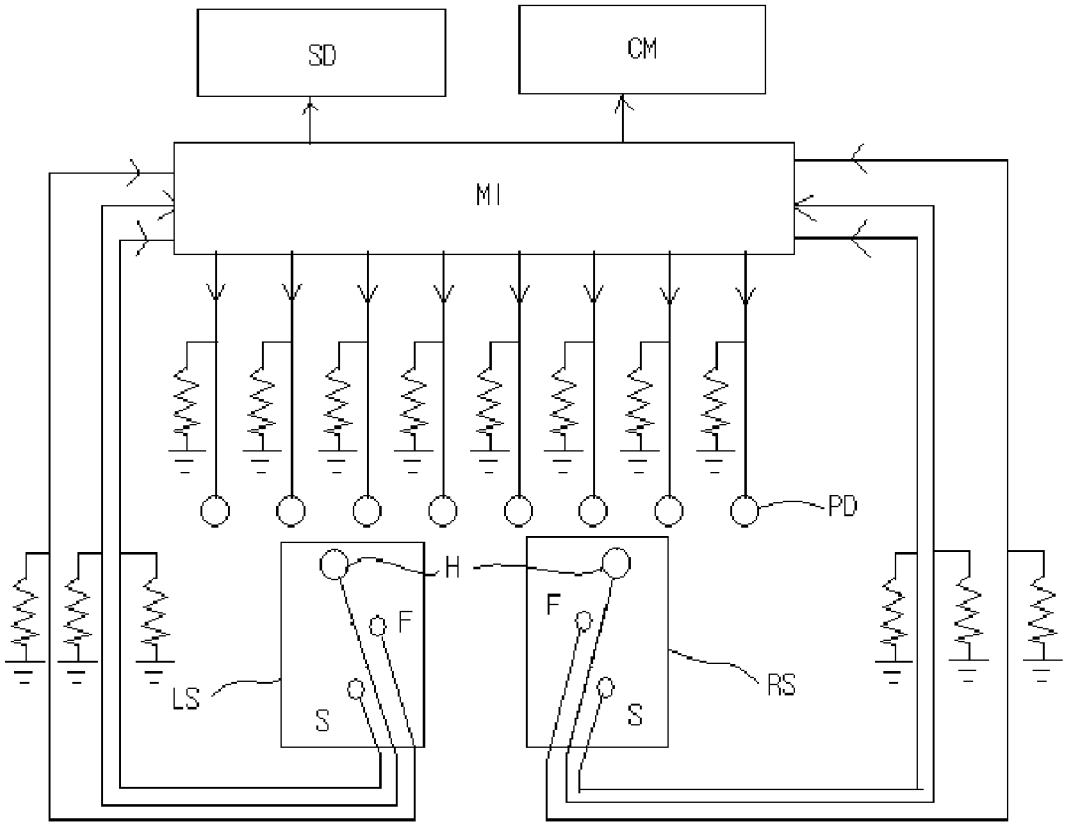
FIG. 7 is the circuit of embodiment 3-2.
Figure 13:
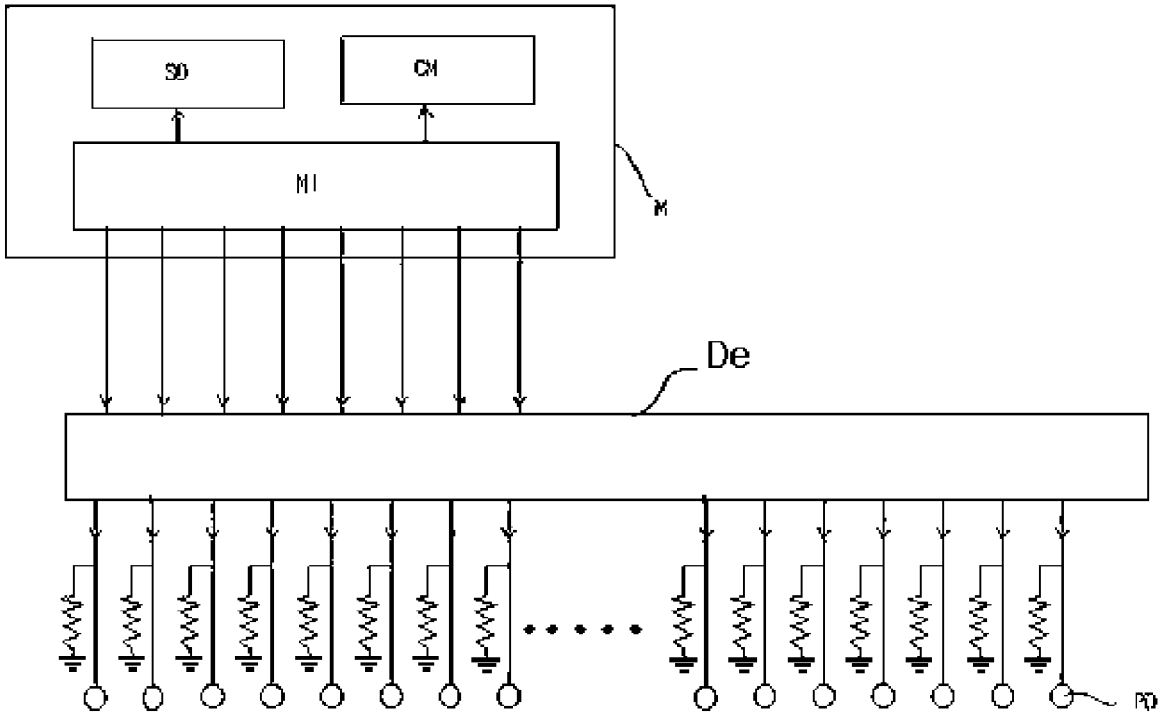
FIG. 13 is the circuit of many pads whose number is increased by decoder circuit.

| Direction of electric signal Detection item | stick->pad | pad->stick |
|---|---|---|
| pad | embodiment 1-1 claim 2 FIG. 2 | embodiment 1-2 claim 3 FIG. 3 |
| Pad and stick | embodiment 2-1 claim 4 FIG. 4 | embodiment 2-2 claim 5 FIG. 5 |
| Pad, stick and impact strength | embodiment 3-1 claim 6 FIG. 6 | embodiment 3-2 claim 6 FIG. 7 |
| Vibration sensor of 1 spring | embodiment 4 claim 9 | |
| Large number of pad | embodiment 5-1 claim 10 FIG. 12 | embodiment 5-2 claim 11 FIG. 13 |

The embodiment 3-1, embodiment 3-2 and embodiment 4 in the above table are recommended for the best mode of present invention.

MODE FOR THE INVENTION

Embodiment 1-1

This embodiment explains how the micro controller (MI) detects the hit pad when electric signal (0 volt) flows from stick (H) to pad (PD) as shown in FIG. 2. The flowing of electric signal from stick (H) to pad (PD) means that 0 volt of stick is inputted to micro controller (MI) through pad. From here, the input ports of microcontroller are drawn as arrows coming toward the microcontroller and the output ports of microcontroller are drawn as arrows coming from microcontroller in FIG. 2~FIG. 13. The microcontroller in FIG. 2 repeats the checking the 8 input ports. Input port of microcontroller is connected with conducting pad. There is space or interval among pads so that there is no touching among pads. Voltage Vcc of power is applied to the conducting pad with pull up resistors. The voltage of such pad falls to 0 volt at the moment of hitting the pad with stick which is grounded. Microcontroller detects the fall of voltage of pad by continuously reading its input ports and generates the sound of drum assigned to the hit pad with sound generation portion (SD) or transmits the drum playing information to the outer device by communication portion (CM). The communication portion (CM) can be USB interface or MIDI interface and the said outer device can be PC, PDA, smart phone or MP3 player and a program running in it generates drum sound with sound module or use the received play information for game play.

Embodiment 1-2

Figure 8:
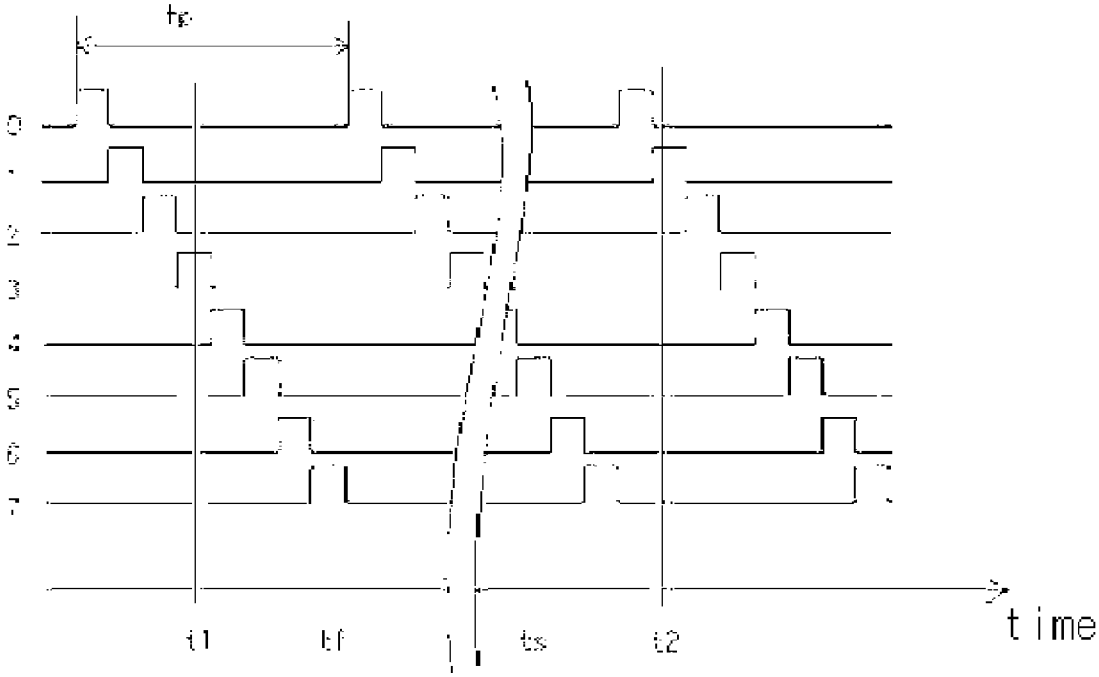
FIG. 8 is time chart of scanning output signal of microcontroller with 8 output port connected to different conducting pad.

This embodiment is obtained by reversing the direction of flow of electric signal of the above embodiment 1-1. As shown in FIG. 3, 8 conducting pads (PD) are connected to the output ports of microcontroller respectively. Each conducting pad is grounded with pull down resistor. And the conducting terminal (H) of stick is connected to the input port of micro controller (MI) where the conducting terminal (H) is grounded with pull down resistor. The microcontroller repeats the outputting scanning signal as shown in FIG. 8. which shows that the microcontroller outputs high volt to the only one output port and outputs low volt to the other output ports at a moment and the output port of high output voltage rotates repeatedly among output ports. Microcontroller reads input ports when it outputting signals as shown in FIG. 8. These processes are summarized as following:

(1) Initialize the output port number i for outputting high volt (for example, 5 volt) to 0 th output port.
(2) output high volt to i th output port and output low volt (for example, 0 volt) to the other output ports.
(3) read input port.
(4) If the rising of voltage of input port is detected then it means that stick hits the i th pad, so generate the sound of i th drum or transmit the hit pad number i to the outer device by communication portion.
(5) increase i by 1(i+1->i)
(6) If i is 8 then reset i to 0.
(7) repeat above process from (2).

Figure 9:
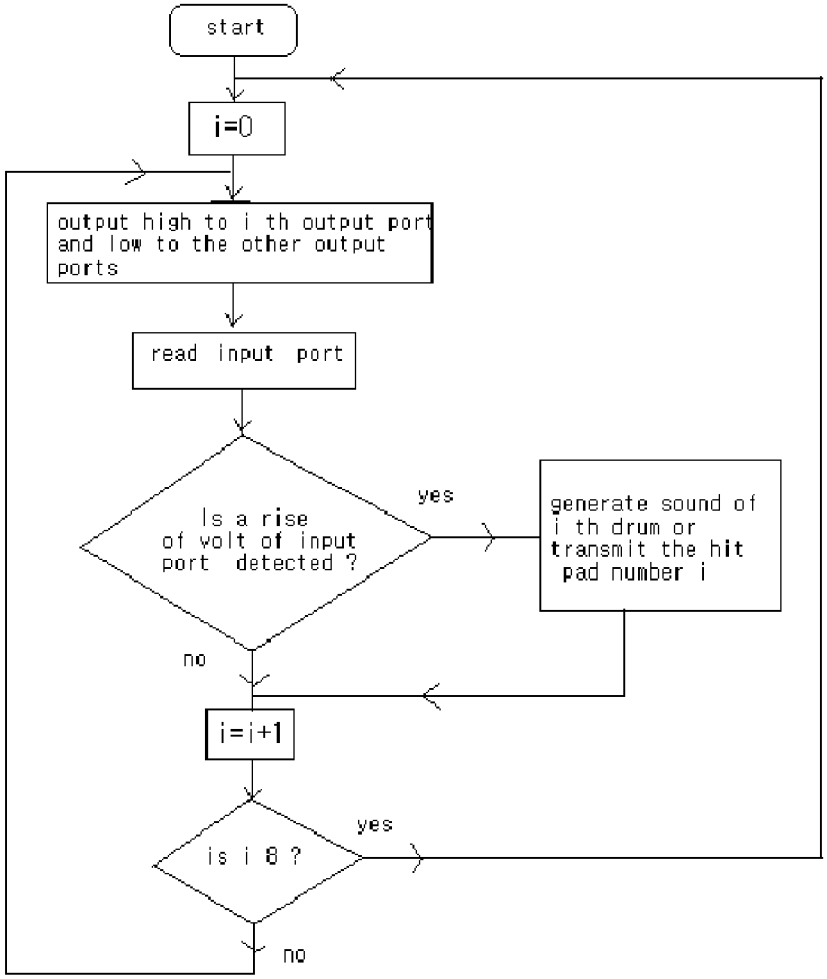
FIG. 9 is flowchart to detect the hit pad by using the scanning output signal of FIG. 8.

The FIG. 9 shows the flow chart of above steps (1)~(7).

Embodiment 2-1

The embodiment shown in FIG. 4 explains how to detect the hit stick by modifying the embodiment 1-1. The detecting hit stick means that the microcontroller recognizes whether the hit stick is left stick (LS) or right stick (RS). In order to recognize which stick hit a pad, Left stick (LS) and right stick (RS) are connected to different output port of microcontroller respectively. In other word, left stick is connected to one output port of microcontroller and right stick is connected to the other output port of micro controller. And microcontroller repeats to read 8 input ports when it repeatedly changes the output pattern between low, high volt and high, low volt to left stick and right stick. These are summarized as following with stick ID assigned 0 to left stick and 1 to right stick.

(1) Output low volt to Left stick, and output high volt to right stick.
(2) Read 8 input ports.
(3) If fall of voltage of i th input port is detected then it means that the left stick hits the i th pad so generate the sound of i th pad drum or transmit the pad ID i and left stick ID 0 to outer system.
(4) Output low volt to right stick, and output high volt to left stick.
(5) Read 8 input ports.
(6) If fall of voltage of i th input port is detected then it means that the right stick hits the i th pad so generate the sound of i th pad drum or transmit the pad ID i and right stick ID 1 to outer system.
(7) repeat above (1)~(6).

Embodiment 2-2

The embodiment shown in FIG. 5 obtained by adding the function of recognizing hit stick to the embodiment 1-2. In order to recognize the hit stick, microcontroller repeats the checking the input ports where Left and right sticks grounded with pull down resistors are connected to the different input ports of microcontroller as shown in FIG. 5. If a rise of voltage from one input port is detected by microcontroller then the stick connected to the input port is recognized as the hitting stick.

Embodiment 3-1

The embodiment as shown in FIG. 6 is obtained by adding the function of detection of hit impact strength to the embodiment 2-1. The detected hit impact strength is used to control the volume of sound of drum by volume control portion in main portion. In general, the volume is controlled to be proportional to the hit impact strength.

In conventional digital piano or MIDI master keyboard, 2 switches are attached to a key. 2 switches are designed so that 1st switch is closed (closed state of switch means on state) at the beginning of key pressing and the 2nd switch is closed at the end of key pressing. The time interval between the two closing moments is detected and used to control the volume of piano key sound. In general, the volume is inverse proportional to the time interval of 2 closing moments.

Similarly, Present embodiment detects the time interval between 2 touching moments of 2 springs (SP1,SP2) in FIG. 10 and FIG. 11. Microcontroller detects the touching between springs (SP1,SP2) and conducting terminal (CY, AX) where the touching occurs when operator hit a pad (PD) with stick (T).

More specific description of the function of spring in FIG. 10 is as following. Two conducting springs (SP1, SP2) of different diameter are aligned serially on the axis of conducting cylinder (CY) which is connected to high voltage Vcc of power. The cylinder (CY) is fixed on stick (T). The outside (FI) of two springs is fixed on stick (T) and the opposite side (MO) of the spring is not fixed so that it can vibrate freely where the outside (FI) of spring means the portion of spring which is not in cylinder (CY). Two springs (SP1, SP2) are grounded with pull down resistors. The spring (SP2) of bigger diameter touches cylinder (CY) and after a moment the spring (SP1) of smaller diameter touches cylinder (CY) when operator hits a pad with stick. This means that the voltage of conducting terminal (F) rises and after a moment, the voltage of conducting terminal (S) rises. Microcontroller recognizes the hit impact strength by measuring the time interval of the said two rises of voltage of two conducting terminals (F, S). In other words, The shorter time interval means the stronger hitting. The conducting terminals (F, S) are attached to left (LS) and right (RS) stick respectively as shown in FIG. 6 and such 4 terminals (F, S) of sticks are connected to 4 different input ports of microcontroller respectively. The other functions except the detection of hit impact strength with springs are the same as the embodiment 2-1.

The spring switches in FIG. 11 also have the same function as the ones in FIG. 10. The only difference is that the conducting shaft (AX) is used in place of conducting cylinder (CY). More specifically speaking, two conducting springs (SP1, SP2) of different diameter is aligned serially on the axis of shaft (AX). The shaft (AX) is fixed on stick (T). One end points (FI) of two springs are fixed on stick (T) respectively and the opposite end points (MO) of springs are not fixed so that they can vibrate freely. The spring (SP1) of smaller diameter touches shaft (AX) and after a moment the spring (SP2) of bigger diameter touches shaft (AX) when operator hits a pad with stick. This means that the voltage of conducting terminal (F) in FIG. 11 rises and after a moment, the voltage of conducting terminal (S) rises. Microcontroller recognizes the hit impact strength by measuring the time interval of the two rises of voltage of two conducting terminals (F, S). Such hit impact strength is used to control the volume of sound of drum or transmitted to outer system.

Embodiment 3-2

The embodiment as shown in FIG. 7 is obtained by adding the function of detection of hit impact strength to the embodiment 2-2.

How to detect the hit impact strength in this embodiment is the same as in the embodiment 3-1.

Embodiment 4

In the above embodiments 3-1 and 3-2, two springs (SP1, SP2) are attached to one stick to recognize the hit impact strength but this embodiment explains how to recognize the hit impact strength with only one spring per stick. Microcontroller detects the touching of stick to pad and after a moment, detects the touching of spring to cylinder (CY) or shaft (AX) when an operator hit a pad with stick. By measuring the time interval between the said two touching moments, Microcontroller recognize the hit impact strength of stick on pad.

Embodiment 5-1

Number of pad can be increased as shown in FIG. 12 by adding encoder circuit (En) to the embodiment 1-1, 2-1 and 3-1. More specifically, FIG. 12 shows that the number of pad (PD) is increased to 255 which is (2 powered by 8) 1 by connecting the pad to input port of encoder and connecting the input port of microcontroller to the output port of encoder where the encoder is the circuit which outputs binary signal corresponding to the input port whose voltage is low and the voltages of the other input ports are all high. For example, 74HC148 is a encoder chip. Microcontroller recognizes the hit pad by detecting the change of input port state of microcontroller and interpreting the read binary data to the hit pad and the other all functions are the same as in embodiment 1-1, 2-1 and 3-1.

Embodiment 5-2

Number of pad can be increased as shown in FIG. 13 by adding decoder circuit (De) to the embodiment 1-2, 2-2 and 3-2. More specifically, FIG. 13 shows that the number of pad (PD) is increased to 255 which is (2 powered by 8) 1 by connecting the pad to output port of decoder and connecting the output port of microcontroller to the input port of decoder where the decoder is the circuit whose outputs are all low except the only one output port which corresponds to the input binary signal. For example, 74HC42 is a decoder chip. About 8 pads can be used as drum pad and the other pads can be used as an electronic xylophone for this and the above embodiment 5-1 which have pads more than 8 with encoder or decoder circuit.

In the above all embodiments, composition obtained by changing of low with high voltage and changing of pull up resistor with pull down resistor have the same functions so they are also the embodiment of the present invention.

INDUSTRIAL APPLICABILITY

Main portion may contain communication portion like USB or MIDI interface to outer system such as PC to transmit the information of playing drum. In this case, the format of communication signal can be MIDI message or private format of the present invention and the outer system generates sound of drum or plays video game with the received signal. If the outer system is PC then the sound can be generated by sound card in PC so the sound generation portion in main portion can be omitted.

By using the present invention, hard, heavy and expensive pad of the conventional electronic drum can be replaced by anything which is cheap light, and soft conducting material like conducting film rubber or metal sheet. Such pad of film or sheet can be rolled or folded so it is more convenient to carry the drum and is cheaper then conventional drum because the pad dose not have any mechanical structure or hard housing generally made by expensive die casting and vibration sensor in pad. By using the ordinary material like metal spoon or dish as a pad, the present invention can give operator surprising feeling and strong interest to music, especially for young operators.

The invention claimed is:

1. An electronic percussion instrument, comprising:

a pad portion of separately located conducting pads;

a stick portion of conducting terminals for hitting the said conducting pad; and a main portion for recognizing which pad is hit by which stick and generating sound of drum assigned for the hit pad or transmitting the playing drum signal to outer system, wherein the stick portion comprises the conducting terminals grounded with pull down resistor and connected to an input port of microcontroller for hitting pad, the pad portion comprises the conducting pads grounded with pull down resistors and connected to different output port of microcontroller in main portion, and the main portion comprises microcontroller which recognizes which pad is hit by stick by continuously checking the rise of voltage of input port of microcontroller and at the same time, by continuously changing the output pattern which has the output ports of low voltage except only one output port of high voltage where the output port of low voltage continuously rotates among output ports.

2. An electronic percussion instrument, comprising:

a pad portion of separately located conducting pads;

a stick portion of conducting terminals for hitting the said conducting pad; and a main portion for recognizing which pad is hit by which stick and generating sound of drum assigned for the hit pad or transmitting the playing drum signal to outer system, wherein the stick portion comprises a conducting terminals connected to different output port of microcontroller for hitting pad, a pad portion comprises the conducting pads applied by power voltage with pull up resistors and connected to different input port of microcontroller in main portion, and a main portion comprises microcontroller which recognizes which pad is hit by stick by continuously checking the fall of voltage of input port of microcontroller and at the same time, by continuously changing the output pattern which has one output port of high voltage and the other output port of low voltage where the output port of high voltage continuously rotates among output ports.

3. An electronic percussion instrument, comprising:

a pad portion of separately located conducting pads;

a stick portion of conducting terminals for hilling the said conducting pad; and a main portion for recognizing which pad is hit by which stick and generating sound of drum assigned for the hit pad or transmitting the playing drum signal to outer system, wherein the stick portion comprises a conducting terminal grounded with pull down resistor and being connected to different input port of microcontroller for hitting pad, a pad portion comprises the conducting pads grounded with pull down resistors and connected to different output port of microcontroller in main portion, and a main portion comprises microcontroller which recognizes which pad is hit by stick by continuously checking the rise of voltage of input port of microcontroller and at the same time, by continuously changing the output pattern which has the output ports of low voltage except only one output port of high voltage where the output port of high voltage continuously rotates among output ports.

4. The electronic percussion instrument of claim 2, wherein the stick portion comprises a vibration sensor for detecting the vibration of stick, the main portion comprises a microcontroller which recognizes the hit impact strength of stick on pad by analyzing the output data of the said vibration sensor for controlling the volume of sound of drum or for transmitting the analyzed data to outer system.

5. The electronic percussion instrument of claim 4, wherein the vibration sensor comprises conducting cylinder applied by high voltage of power, and two conducting springs of different diameter serially aligned in the cylinder and aligned on the axis of the cylinder with spatial interval between two springs not to touch each other, where the outside of two springs is fixed on stick and the opposite side of the springs in cylinder is not fixed so that it can vibrate freely and touch the cylinder not simultaneously and two springs are grounded with pull down resistors and connected to the different input port of micro controller, the main portion comprises a microcontroller which recognizes the hit impact strength of stick on pad by measuring the time interval of the two rises of voltage of two conducting springs.

6. The electronic percussion instrument of claim 4, wherein the vibration sensor comprises a conducting shaft applied by high voltage of power, and two conducting springs of different diameter serially aligned on the axis of the shaft with spatial interval between two springs not to touch each other, where the outside of two springs is fixed on stick and the opposite side of the springs over shaft is not fixed so that it can vibrate freely and touch the shaft not simultaneously and two springs are grounded with pull down resistors and connected to the different input port of micro controller, the main portion comprises a microcontroller which recognizes the hit impact strength of stick on pad by measuring the time interval of the two rises of voltage of two conducting springs.

7. The electronic percussion instrument of claim 4, wherein the vibration sensor comprises a conducting terminal applied by high voltage of power, and one conducting spring with spatial interval from the said terminal not to touch the said terminal without outer acceleration but to touch the said terminal with outer acceleration whose one end point is fixed on stick where the spring is grounded with pull down resistor and connected to the input port of micro controller, the main portion comprises microcontroller which recognizes the hit impact strength of stick on pad by measuring the time between the moment of the touching of stick on pad and the moment of the rise of voltage of spring.

8. The electronic percussion instrument of claim 2, wherein the main portion comprises:

(1) a encoder circuit which outputs binary data corresponding to input data whose pattern has input ports of high voltage except only one input port of low voltage where each input port of encoder circuit is connected to different conducting pad and each output port of encoder circuit is connected to different input port of microcontroller; and (2) a microcontroller to recognize the hit pad by analyzing the binary input data.

9. The electronic percussion instrument of claim 1, wherein the main portion comprises (1) a decoder circuit whose output pattern have output ports of low voltage except only one output port of high voltage where the output data corresponds to the binary input data where each output port of decoder circuit is connected to different conducting pad and each input port of decoder circuit is connected to different output port of microcontroller and (2) a microcontroller for recognizing the hit pad by continuously checking the input port and at the same time by increasing and rotating the binary output pattern from 0 to maximum value-1 corresponding to the number of pad.

* * * * *